US005655207A

United States Patent [19]

Sugiyama et al.

[11] Patent Number: 5,655,207

[45] Date of Patent: Aug. 5, 1997

[54] IMAGE FORMING APPARATUS PROVIDED WITH A TAB SHEET INSERTING FUNCTION

[75] Inventors: Tsukasa Sugiyama; Ken Yoshizuka, both of Osaka, Japan

[73] Assignee: Mita Industrial Co., Ltd., Osaka-fu, Japan

[21] Appl. No.: 610,509

[22] Filed: Mar. 4, 1996

[30] Foreign Application Priority Data

Mar. 7, 1995 [JP] Japan ..... 7-047489

[51] Int. Cl.[6] ..... G03G 21/00

[52] U.S. Cl. ..... 399/382

[58] Field of Search ..... 399/382; 270/58.01

[56] References Cited

U.S. PATENT DOCUMENTS 4,561,772 12/1985 Smith ..... 399/367
5,257,081 10/1993 Kato et al. ..... 399/382
5,559,595 9/1996 Farrell ..... 355/325

*Primary Examiner*—Nestor Ramirez

*Attorney, Agent, or Firm*—Jordan and Hamburg

[57] ABSTRACT

An image forming apparatus capable of inserting tab sheets between copied sheets is provided with a cassette for containing tab sheets is such a state that tabs of the tab sheets project backward with respect to a feed direction, a sheet inverting assembly provided downstream from the imaging assembly for discharging the sheet to the discharging portion after reversing its transport direction, an inserting position setting device for setting an inserting position of the tab sheet in a plurality of copy sheets to be stackingly discharged, a feed controller for feeding a tab sheet from the cassette during a processing in the inserting position, an image formation prohibiting device for prohibiting an image formation during the processing in the inserting position, and a transport controller for, when the fed sheet is a tab sheet, transporting the tab sheet to the sheet inverting assembly. When tab sheets are to be inserted in specified inserting positions while a plurality of documents are copied, the tab sheets are fed in such a manner that their tabs project backward with respect to their feed direction and has their transport direction reversed before being discharged so that their tabs project forward.

6 Claims, 13 Drawing Sheets

IMAGE FORMING APPARATUS PROVIDED WITH A TAB SHEET INSERTING FUNCTION

BACKGROUND OF THE INVENTION

This invention relates to an image forming apparatus capable of performing a copying operation while inserting a tab sheet into a specified position (between specified pages) of a copied material which is stackingly discharged onto a discharge tray and, particularly to a transport of a tab sheet to be inserted.

Along with a tendency to provide a multitude of functions and high performance, some of commercially available image forming apparatuses such as copiers are provided with a plurality of copy sheet feeder units arranged stage by stage which are capable of continuously feeding a plurality of sheets different in size and material. In recent years, as the copiers have more functions, there has been a demand from users' side for a function of automatically inserting a tab sheet (sheet provided with a tab at its side edge) in a specified position (between specified pages) of a copied material.

Even in the existing copier, both tab sheets and normal copy sheets (hereafter, "normal sheets") can be fed if they are set in a plurality of copy sheet feeder units. However, these copiers are not provided with a special copying mode, it is impossible to, in a normal copying mode, perform a copying operation while automatically inserting the tab sheets in specified positions.

If the existing copier is provided with a special copying mode for inserting tab sheets, and a sheet to be fed is switched from the normal sheet to the tab sheet in a specified tab sheet inserting position (insertion page) in this mode, the tab sheets can be automatically inserted. However, considering processings during the transport of the tab sheet after being fed from the feeder unit and after being discharged, it is difficult to suitably produce a copied material with the inserted tab sheets simply by switching the sheets to be fed.

Specifically, since a tab projects from a longitudinal side edge of the tab sheet, it is necessary to set the tab sheets with their longer sides having no tab facing forward and to feed the tab sheets with their longitudinal direction normal to their feed direction in consideration of positioning of the leading ends of the tab sheets by the registration rollers, sheet alignment and sheet processing such as punching and stapling applied after the copied sheets are discharged onto the discharge tray. It is also necessary to reverse the transport direction of the tab sheet so that the longer side thereof having a tab comes forward after the tab sheet passes the fixing device. However, the prior art copiers are not provided with a function of reversing the transport direction of the tab sheet, and this leads to problems such as an erroneous feed timing, an error feeding such as oblique feeding, misalignment of the copied material in which the tab sheets are inserted, and a sheet processing error.

SUMMARY OF THE INVENTION

It is an object of the present invention to .provide an image forming apparatus provided with a tab inserting function which has overcome the problems residing in the prior art.

It is another object of the present invention to provide an image forming apparatus provided with a tab sheet inserting function which can properly feed and transport tab sheets and produce a suitable copied material in which tab sheets are inserted.

The invention is directed to an image forming apparatus capable of inserting tab sheets between copied sheets, in which a plurality of documents are fed one by one to a scanning position and toner images of the respective documents are formed in an imaging assembly in accordance with the images scanned in the scanning position while copy sheets are fed to the imaging assembly in synchronism with feed of the respective documents, and the toner images are transferred to the copy sheets which are then stackingly discharged in a discharging portion, comprising a tab sheet feeding device which contains tab sheets such that tabs of the tab sheets project backward with respect to a feed direction; a sheet inverting device which is provided downstream from the imaging assembly and discharge the sheet to the discharging portion after reversing its transport direction; inserting position setting device for setting an inserting position of the tab sheet in a plurality of copy sheets to be stackingly discharged; a feed control device which feeds a tab sheet from the tab sheet feeding device during a processing in the inserting position; an image formation prohibiting device which prohibits an image formation during the processing in the inserting position; and a transport controller which transports, when the fed sheet is a tab sheet, the tab sheet to the sheet inverting device.

In the image forming apparatus thus constructed, during the copying operation for a plurality of documents, the tab sheet is fed from the tab sheet feeding device in the specified inserting position and is discharged without having no image copied thereon. Before being discharged, the tab sheet is transported with its tab at the back with respect to its transport direction. Accordingly, the tab sheet has its transport direction reversed in the sheet inverting device so that the tab is located at the front. Accordingly, tabs do not stand as obstacles when the tab sheets are aligned before being fed and when the rear ends of the copied sheets are positioned during a sheet processing performed after the copied sheets are discharged. This securely prevents a shift in a feed timing of the tab sheets, feed errors such as oblique feeding, and sheet processing errors such as when positioning, punching or stapling is applied to the copied sheets which are stackingly discharged.

The image forming apparatus according to the invention may be further provided with a refeeding device which feeds the copy sheet having an image copied on the front side thereof again to the imaging assembly so as to form an image on the rear side of the copy sheet, and a transport path switching device which switches a transport path of the sheet being transported to the refeeding device and to the discharging portion.

Particularly, the sheet inverting device preferably includes a switching member having a triangular cross section which is movable between a discharge position where it guides the sheet to the discharging portion and a circulation position where it guides the sheet to the refeeding device; three guide plates disposed in parallel to the respective planes of the switching portions so as to define, together with the switching portion, a first discharge path for guiding the sheet transported from the imaging assembly to the discharging portion, a circulation path for guiding the sheet to the refeeding device, and a second discharge path for guiding the sheet having its transport direction reversed to the discharging portion; a driving device which is provided in a specified position along a transport path extending from the circulation path to the refeeding device to transport the sheet to have its transport direction reversed back to the second discharge path; a switch control device which moves, when the sheet being transported is a tab sheet, the switching member to the circulation position; and a drive controller which drives, when the sheet being transported is a tab sheet, the driving device at a specified timing after the tab sheet passes the circulation path.

With the above arrangement, in the image forming apparatus having a duplex copying function, since the sheet inverting device is provided with the transport path switching device, the construction of the transport paths where the transport of the sheet is switched can be simplified.

Further, the inserting position setting device may be preferably realized by an automatic document feeder for feeding a plurality of documents one by one to the scanning position, the documents including a special document inserted in a specified page position to indicate a tab sheet inserting position, and includes a distinguishing device which distinguishes the special document from other normal documents; a counting device which counts the number of the normal documents; and a position determining device which determines the inserting position of the tab sheet in a plurality of stackingly discharged copied sheets in accordance with the number of the normal documents.

With this arrangement, the tab sheet inserting positions can be automatically input by feeding a document set including a plurality of documents in which special documents indicative of the tab sheet inserting positions are inserted by device of the automatic document feeder.

Alternatively, the inserting position setting device may be provided with an information inputting device which inputs information concerning the latter one of the pages between which the tab is inserted; and a position determining device which determines the inserting position of the tab sheet in a plurality of stackingly discharged copied sheets in accordance with the information input by the page information inputting device.

With this arrangement, the tab sheet inserting positions can be also manually set.

The image forming apparatus according to the invention may be further provided with a mode setting device which sets a tab sheet copying mode; and a prohibition removing device which removes, when the tab sheet copying mode is set, a prohibition on the image formation during the processing in the inserting position so as to form an image on the tab sheet fed from the tab sheet feeding device.

With this arrangement, information including comments or indices can be easily copied on the inserted tab sheet by setting the tab sheet copying mode.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
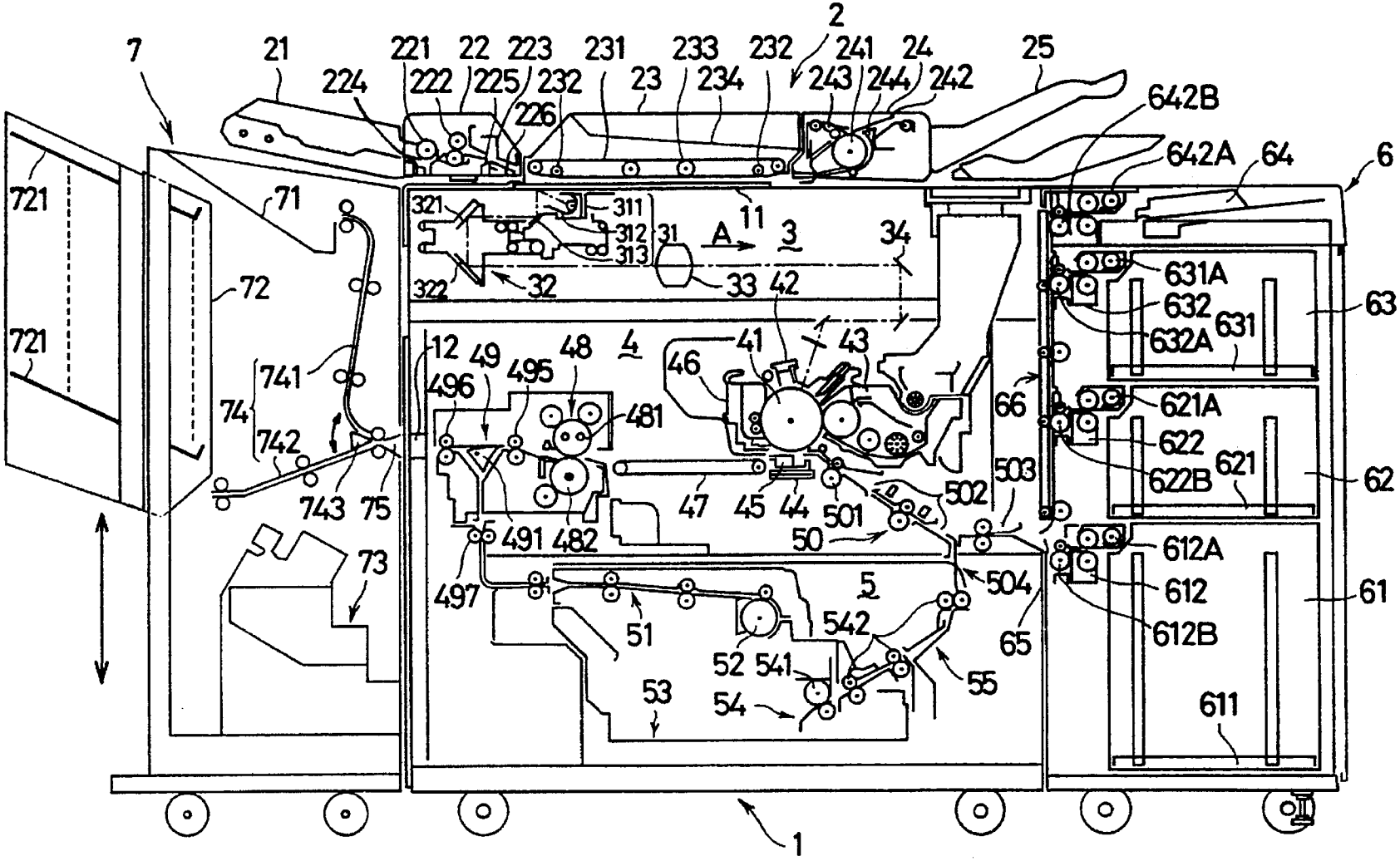
FIG. 1 is an entire construction diagram of an exemplary copier according to the invention which is capable of inserting tab sheets.

FIG. 1 is an entire construction diagram of an exemplary copier according to the invention which is capable of inserting tab sheets.

In the copier shown in FIG. 1, a mode for producing a copied material while inserting tab sheets in designated positions (between designated pages) is settable. Hereafter, this mode is referred to as a tab sheet insertion mode. During a copying operation in the tab sheet insertion mode, a sheet to be fed is switched between a normal sheet and a tab sheet depending upon a copying position of a set of documents (whether a page of the documents is a normal sheet or an inserted tab sheet), and an image is formed on the fed sheet. The tab sheet insertion mode is described later.

In FIG. 1, the copier is provided with a transparent document platen 11 of glass as a document placing plate on the upper surface of its main body 1. An automatic document feeder 2 for automatically feeding documents is openably and closably mounted on the document platen 11. The automatic document feeder 2 also functions as a means for inputting tab sheet inserting positions to be described later.

An operation panel (not shown) is provided on the upper surface of the copier main body 1. By operating the operation panel, a tab sheet insertion mode is settable beside a variety of copying modes such as a duplex copying mode, a reduction copying mode and an enlargement copying mode, the number of copies to be made for each document, the size of copy sheets, a selected copy sheet cassette.

An optical assembly 3, an imaging assembly 4, and a refeeding assembly 5 are provided in upper, middle and lower parts of the interior of the copier main body 1. Further, a sheet feeder unit 6 for feeding a copy sheet to the imaging assembly 4 and a sheet processor 7 for sorting, punching and stapling sheets bearing copied images (copied material) are arranged at the right and left sides of the main body 1, respectively.

In the automatic document feeder 2, a document setting portion 21, a document feeding assembly 22, a document transporting assembly 23 provided with a second document discharging portion 231 on its upper surface, and a document inverting assembly 24, and a first document discharging portion 25 are arranged in this order from the left end to the right end. The document feeder 2 is capable of feeding both upward faced documents and downward faced documents. In order to set the documents in a scanning position on the document platen 11, faced downward, regardless of whether the set document is faced upward or downward and to discharge the documents without changing the order thereof, the document transporting assembly 23, the second document discharging portion 231, the document inverting assembly 24 and the first document discharging portion 25 are arranged.

The document setting portion 21 is adapted to set the documents. The document feeding assembly 22 includes a pick-up roller 221, a pair of feed rollers 222 and a document guide plate 223, and is adapted to feed the documents set in the document setting portion 21 one by one from the uppermost one to the document platen 11.

A document sensor 224 is disposed below the pick-up roller 221 for detecting whether the document is set in the document setting portion 21. A registration switch 225 for detecting a feed of the document and a special document switch 226 for detecting a special document are disposed in specified positions downstream from the feed rollers 222, respectively.

The special document refers to a document affixed with a scannable code and/or a scannable mark for indicating inserting positions of tab sheets. The tab sheet inserting positions are input by means of the automatic document feeder 2 as follows. A set of documents including the special documents inserted in specified positions are fed by the document feeder 2. By detecting the special documents, the tab sheet inserting positions (page numbers of the tab sheets) in the copied material after the tab sheets are inserted are automatically input. A method for inputting the tab sheet inserting positions is described later.

The document transporting assembly 23 includes a transport belt 231, drive rollers 232 for drivingly rotating the transport belt 231 and guide rollers 233 for guiding the rotation of the transport belt 231, and is adapted to transport the document to a specified scanning position on the document platen 11 and to discharge the document after a copying operation. When the document is set in the document setting portion 21, faced downward, the document transporting assembly 23 transports it straight to the scanning position. On the other hand, when the document is set in the document setting portion 21, faced upward, the document transporting assembly 23 first transports it to the document inverting assembly 24 and then transports the inverted document from the document inverting assembly 24 to the scanning position.

The document inverting assembly 24 includes an inversion guide 241 for defining an inversion path, a first discharge guide 242 for defining a discharge path to the first document discharging portion 25, a second discharge guide 243, and a switching member 244 for switching a path of the document between the inversion path and the discharge path to the first document discharging portion 25. The document inverting assembly 24 sends the document back to the document transporting assembly 23 after inverting it and discharges the document to the first or second document discharging portion 25 or 231. The document inverting assembly 24 discharges the document straight to the first document discharging portion 25 when the document is set, faced downward, while discharging it to the second document discharging portion 231 after inverting it when it is set, faced upward.

The optical assembly 3 includes a first optical system 31, a second optical system 32, a lens 33 and a reflecting mirror 34, and is adapted to introduce a light representing a document image to the imaging assembly 4 by dividing it into slits. The first optical system 31 includes a halogen lamp 311, a reflector 312 and a reflecting mirror 313, and is adapted to illuminate the document placed in the scanning position and introduce the light reflected by the document to the second optical system 32. The second optical system 32 includes two reflecting mirrors 321, 322 and is adapted to introduce the reflected light from the first optical system 31 to the lens 33. The lens 33 is adapted to focus the light image on a photosensitive drum 41 of the imaging assembly 4. The reflecting mirror 34 is adapted to introduce the reflected light from the document which has passed through the lens 33 to the photosensitive drum 41.

The first and second optical assemblies 31, 32 are reciprocatingly moved by an unillustrated drive motors at specified speeds along the document platen 11, spaced apart by a specified distance. By scanning the document placed in the scanning position in a main scanning direction (a direction of A in FIG. 1), the entire document image is projected onto the photosensitive drum 41.

The imaging assembly 4 includes a photosensitive member including the drum 41, a main charger 42, a developing device 43, a transferring device 44, a separating device 45 and a cleaning device 46 arranged in this order around the drum 41 from an upstream side with respect to its rotating direction. The imaging assembly 4 also includes a transporting device 47, a fixing device 48, a transport path switching assembly 49, and a sheet feeding assembly 50.

The transporting device 47 is disposed below the drum 41 and downstream from the separating device 45, and the sheet feeding assembly 50 is disposed below the drum 41 and upstream of the transferring device 44. The fixing device 48 and the transport path switching assembly 49 are disposed in this order downstream from the transporting device 47.

The drum 41 is adapted to form an electrostatic latent image of a document image upon receipt of the light from the optical assembly 3. The main charger 42 releases charges so that the drum 41 is charged at a specified potential for forming an electrostatic latent image. The developing device 43 electrostatically attaches toner to the latent image formed on the surface of the drum 41 to develop it into a toner image. The transferring device 44 transfers the toner image of the document formed on the surface of the drum 41 to a sheet fed from the sheet feeder unit 6 via the sheet feeding assembly 50. The separating device 45 separates the sheet bearing the copied image from the drum 41. The cleaning device 46 removes the toner remaining on the drum 41 after the sheet is separated from the drum 41.

The transporting device 47 transports the sheet separated from the drum 41 to the fixing device 48. The fixing device 48 includes a heating roller 481 and a pressure roller 482 which are in pressing contact with each other, and thermally fuses the toner image transferred to the sheet, thereby fixing the toner image onto the sheet.

The transport path switching assembly 49 switches a transport path of the sheet bearing the copied image, and transports the sheet to the sheet processor 7 after reversing its transport direction. The switching assembly 49 constitutes sheet inverting means according to the invention and is provided with a so-called "switch-back" function so as to discharge a tab sheet after reversing a transport direction thereof during a tab sheet insertion processing in a tab sheet insertion mode to be described later.

Figure 2:
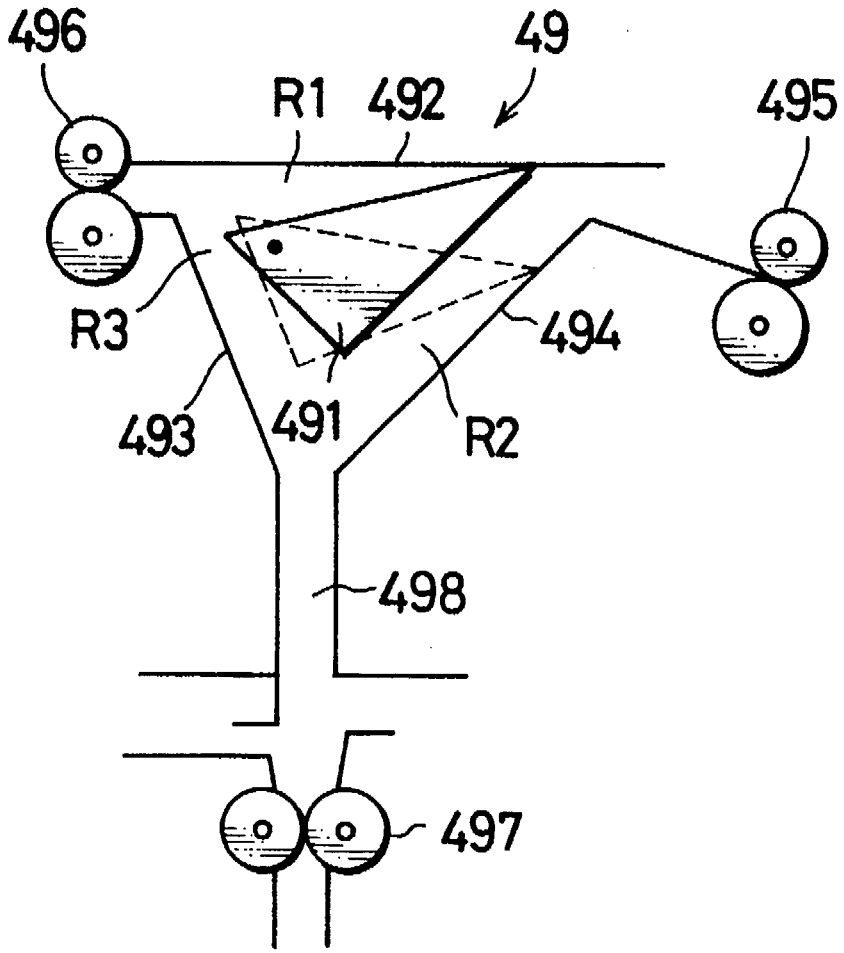
FIG. 2 is a schematic diagram of a transport path switching portion.

The switching assembly 49 includes, as shown in FIG. 2, a switching member 491 having a triangular cross section, guide plates 492 to 494 facing the respective surfaces of the switching member 491, pairs of transport rollers 495, 496 and 497, and a transport path 498. Between the switching member 491 and the guide plates 492 to 494, there are formed three paths: a first discharge path R1, a circulation path R2 and a second discharge path R3. The transport rollers 495, 496 are disposed at upstream and downstream ends of the first discharge path R1. The transport rollers 497 send to the refeeding assembly 5 the sheet transported to a specified position along the transport path 498 extending from the circulation path R2 to the refeeding assembly 5, and send the sheet transported thereto to have its transport direction reversed to the second discharge path R3.

The switching member 491 is pivoted by an unillustrated solenoid between a discharge position where it blocks the circulation path R2 (indicated by dotted line in FIG. 2) and a circulation position where it blocks the first discharge path R1 (indicated by solid line in FIG. 2). The transport path of the document is switched between the first discharge path R1 and the circulation path R2 by pivoting the switching member 491.

A sheet bearing a copied image is transported via the first discharge path R1 to a sheet discharge slot 12 formed in a specified position on the left side surface of the copier main body 1. At the time of duplex copying, a sheet having an image copied on its front side (hereafter, "one-side copied sheet") is transported to the refeeding assembly 5 via the circulation path R2. A sheet having its transport direction reversed is transported to the sheet discharge slot 12 via the second discharge path R3.

When simplex copying is applied to a normal sheet, the switching member 491 is set in the discharge position and the normal sheet from the fixing device 48 is discharged to the sheet processor 7 via the first discharge path R1. When duplex copying is applied to a normal sheet, the switching member 491 is set in the circulation position during the first copying (front side copying) and the normal sheet from fixing device 48 to the refeeding assembly 5 via the circulation path R2, and is set in the discharge position during the second copying (rear side copying) and the normal sheet from the fixing device 48 is discharged to the sheet processor 7 via the first discharge path R1.

During the tab sheet insertion processing, the tab sheet has its transport direction reversed by setting the switching member 491 in the circulation position and controllably driving the transport rollers 497. When the tab sheet is fed, the switching member 491 is set in the circulation position and the tab sheet from the fixing device 48 is transported to the refeeding assembly 5 via the circulation path R2. At this time, after transporting the tab sheet toward the refeeding assembly 5 by at least a longer dimension of the tab sheet, the transport rollers 497 are driven in the reverse direction while the tab sheet is held therebetween. In this way, the transport direction of the tab sheet is reversed and the tab sheet is discharged to the sheet processor 7 via the second discharge path R3.

The sheet feeding assembly 50 includes a pair of registration rollers 501 and a sheet guide 502 defining a sheet transport path, and transports a sheet fed from the sheet feeder unit 6 to the drum 41 at a specified timing so that a document image can be formed on the sheet. Upstream from the sheet guide 502, a sheet guide 503 for guiding a sheet fed from the sheet feeder unit 6 and a sheet guide 504 for guiding a sheet refed from the refeeding assembly 5 are joined. When duplex copying is applied to a normal sheet, the sheet fed from the sheet feeder unit 6 is transported to the registration rollers 501 via the sheet guide 503 during the first copying, and the one-side copied sheet refed from the refeeding assembly 5 is transported to the registration rollers 501 via the sheet guide 504.

The refeeding assembly 5 includes sheet guiding portions 51, 55, a sheet inverting portion 52, an intermediate tray 53, and a sheet refeeding portion 54. In a duplex copying mode, in order to apply copying to the one-side copied sheet, the refeeding assembly 5 refeeds this sheet to the imaging assembly 4. The sheet guiding portion 51 guides the one-side copied sheet transported via the circulation path R2 of the transport path switching assembly 49 to the sheet inverting portion 52. The sheet inverting portion 52 inverts the sides of the one-sided copied sheet. The intermediate tray 53 temporarily accommodates the one-side copied sheet therein.

The sheet inverting portion 52 is provided to invert the one-side copied sheet by an odd number of times while it is refed. The one-side copied sheet is inverted by the circulation path R2 of the transport path switching assembly 49, the sheet inverting portion 52 and the refeeding assembly 5, i.e. it is inverted three times in total. The copying surface after the second inversion is different from the copying surface after the first inversion.

The sheet refeeding portion 54 includes a pair of pick-up rollers 541 and pairs of transport rollers 542, and refeeds the one-side copied sheet accommodated in the intermediate tray 53 at a specified timing. The sheet guiding portion 55 guides the refed one-side copied sheet to the sheet feeding assembly 50 of the imaging assembly 4.

The sheet feeder unit 6 includes three cassettes 61, 62 and 63 movable upward and downward and arranged in different stages, and a single manual insertion tray 64, and constitutes tab sheet feeding means and sheet feeding means according to the invention. The cassette 61 having a maximum capacity is arranged at the bottom, and the manual insertion tray 64 is arranged at the top. Normal sheets or tab sheets are accommodated in the cassette 61, 62 and 63 or the manual insertion tray 64.

The cassettes 61, 62 and 63 include sheet placing beds 611, 621 and 631 movable upward and downward, and feeding devices 612, 622 and 632 which are adapted to feed the sheets placed on the sheet placing beds 611, 621 and 631 and disposed in positions above the leading ends of the placed sheets. A sheet discharge slot 65 is formed downstream from the sheet placing bed 611 of the bottommost cassette 61. The sheet from the feeder unit 6 is transported to the sheet feeding assembly 50 of the imaging assembly 4 through the sheet discharge slot 65. A sheet guiding portion 66 is provided above the sheet discharge slot 65 formed on the front surface (left surface in FIG. 1) of the feeder unit 6. The sheet guiding portion 66 transports the sheets fed from the manual insertion tray 64, the upper cassette 62 and the middle cassette 63 to the sheet discharge slot 65.

The respective feeding devices 612, 622, 632 include pick-up rollers 612A, 622A, 632A and pairs of feed rollers 612B, 622B, 632B. The uppermost ones of the sheets placed on the sheet placing beds 611, 621 and 631 and the manual insertion tray 64 are picked up by the pick-up rollers 612A, 621A, 631A and 642A, and fed by the feed rollers 612B, 622B, 632B and 642B. The sheet fed from the cassette 61 is transported to the sheet feeding assembly 50 in the main body 1 through the sheet discharge slot 65. On the other hand, the sheets fed from the manual insertion tray 64 and the cassettes 62, 63 are transported to the sheet feeding assembly 50 in the main body 1 through the sheet discharge slot 65 after being transported to the slot 65 by the sheet guiding portion 66.

The sheet processor 7 is provided with a discharge tray 71 on its upper surface and a sorter 72 including a plurality of bins 721 on its left surface. The discharge tray 71 and the sorter 72 constitute discharging means according to the invention. A sheet processing device 73 for applying punching and stapling is disposed at the bottom of the sheet processor 7. A sheet guiding assembly 74 is disposed above the sheet processing device 73.

The sheet guiding assembly 74 includes a first transport path 741, a second transport path 742 and a switching portion 743. The sheet transported through a sheet slot 75 formed on the right surface of the sheet processor 7 is guided to the discharge tray 71 along the first transport path 741. Further, the sheet transported through the sheet slot 75 is guided to the sorter 72 along the second transport path 742. The switching portion 743 is disposed near the sheet slot 75 for switching the transport paths 741 and 742. The first transport path 741 extends upward from the switching portion 743 to the discharge tray 71. The second transport path 742 extends substantially linearly and obliquely downward from the switching portion 743 to a specified position where a sheet processing is applied. This specified position corresponds to a sheet processing position of the sheet processing device 73.

The switching portion 743 includes a switching member having a triangular cross section which partly forms guide plates of the first and second transport path 741 and 742. The switching member is pivoted by an unillustrated solenoid between a discharge portion (where it blocks the second transport path 742) and a sorter position (where it blocks the first transport path 741), thereby switching the first and second transport paths 741 and 742.

The sheets which are not to be sorted are discharged onto the discharge tray 71. The sorter 72 is movable upward and downward as a single unit, and the respective bins 721 are movable in the forward/backward direction (discharge direction of the sheet). During a sorting operation, the sorter 72 is moved upward and downward to set the respective bins 721 in the specified position, and the sheet transported along the second transport path 742 is discharged onto the set bin 721. The specified position corresponds to the sheet processing position of the sheet processing device 73. When the sheet processing is applied, each bin 721 is set in the specified position and moved toward the sheet processing device 73. Further, the sheets placed on the bin 721 are moved to the sheet processing position of the sheet processing device 73 and a specified processing such as punching or stapling is applied thereto.

Figure 3:
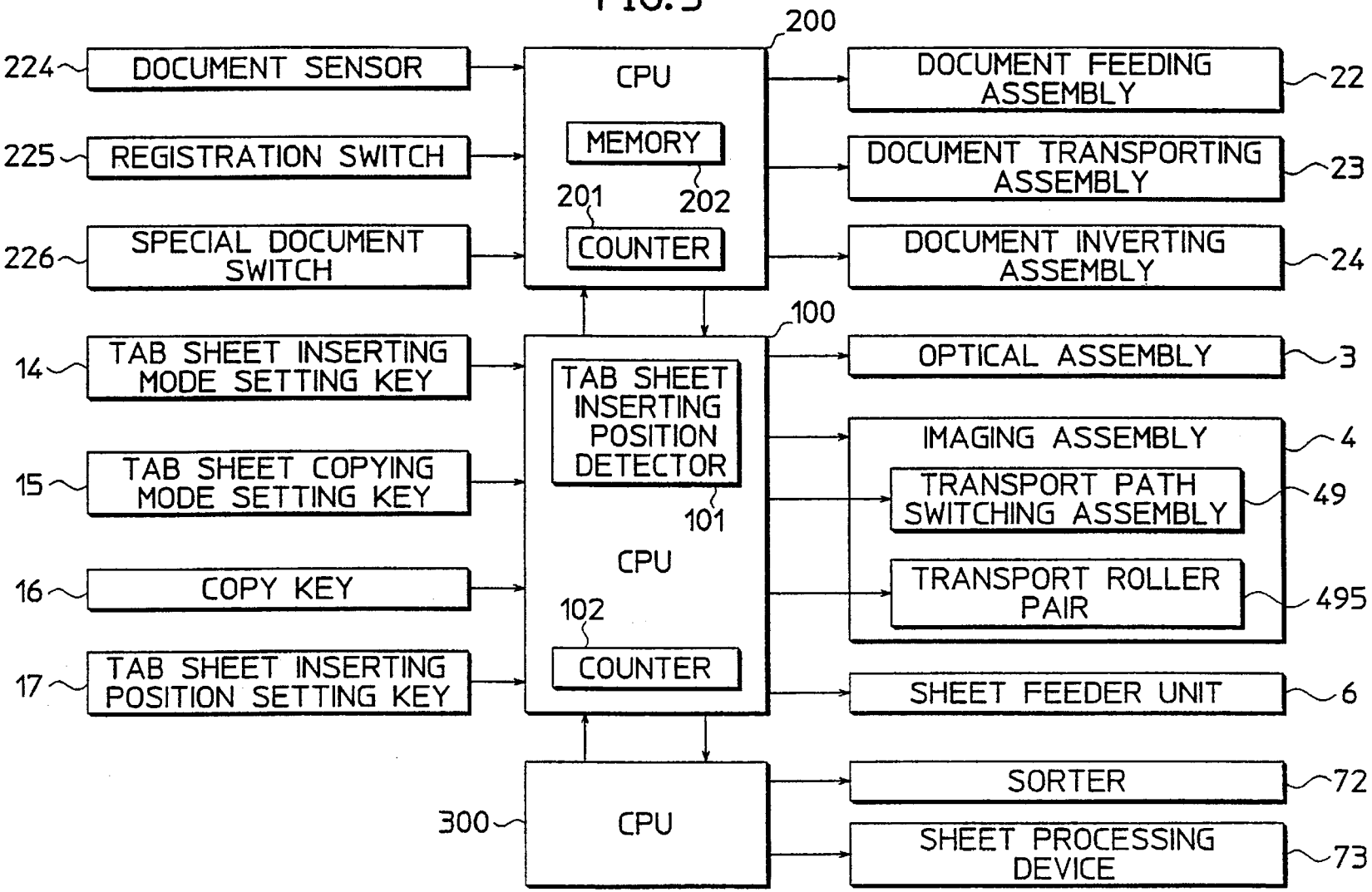
FIG. 3 is a block diagram showing a tab sheet insertion control implemented in the copier.

FIG. 3 is a block diagram showing a tab sheet insertion control executed in the copier. In FIG. 3, elements same as those shown in FIGS. 1 and 2 are identified by the same reference numerals.

A CPU 200 is a controller for centrally controlling the document feeding operation performed in the automatic document feeder 2. Specifically, the CPU 200 controls the driving of the document feeding assembly 22, document transporting assembly 23 and document inverting assembly 24 to perform a specified document feed control according to the set copying mode.

A CPU 100 is a controller for centrally controlling the copying operation performed in the copier main body 1. Specifically, the CPU 100 controls the driving of the optical assembly 3, imaging assembly 4 and feeder unit 6 to perform an image forming processing and a tab sheet insertion processing for the respective documents. The CPU 100 causes the feeder unit 6 to feed the normal sheet during the copying operation for the normal document, while causing it to fed the tab sheet during the copying operation in the tab sheet inserting position. The CPU 100 also constitutes transport control means according to the invention. When the sheet is discharged after having its transport direction reversed, the CPU 100 sends a switch signal to the transport path switching assembly 49 to switch the transport path to the circulation path R2. When the sheet reaches the transport rollers 497 along the circulation path R2, the CPU 100 reverses the driving direction of the transport rollers 497 to reverse the transport direction of the sheet and discharge it.

A CPU 300 is a controller for centrally controlling the sheet processing operation performed in the sheet processor 7. Specifically, the CPU 300 controls the driving of the sorter 72 and the sheet processing device 73 to perform a sheet processing in accordance with the set sheet processing mode.

The CPUs 100, 200 and 300 can conduct a data communication with one another. By transmitting and receiving mutually necessary information, the automatic document feeder 2, copier main body 1 and sheet processor 7 are meaningfully united to perform a series of copying operations. For example, the CPU 200 transmits to the CPU 100 a data concerning the tab sheet inserting positions which are detected in advance in the document feeder 2 and an information concerning the feed of the documents and completion thereof which are detected during the copying operation. The CPU 100 transmits a document interchange requirement signal, a document feed timing signal, etc. to the CPU 200. The CPU 100 transmits an information concerning the set sheet processing to the CPU 300.

Although the tab sheet inserting position data is input by feeding the documents by means of the automatic document feeder 2 in this embodiment, a tab sheet inserting position setting key 17 may be provided in the operation panel and the tab sheet inserting positions (which page from the first document) may be input by means of the key 17.

A counter 201 built in the CPU 200 has a plurality of count portions, and is adapted to count the number J of the set documents and pointers K indicative of the tab sheet inserting positions. Memories 202 built in the CPU 200 store the tab sheet inserting positions detected in accordance with the count value of the counter 201 and the detection result of the special document detection switch 26.

The tab sheet inserting mode setting key 17 is operated to set the tab sheet insertion mode, and a tab sheet copying mode setting key 15 is operated to set a mode in which a document image is formed not only on the normal sheet, but also on the tab sheet. A copy key 16 is operated to start the copying operation.

A tab sheet inserting position detector 101 built in the CPU 100 detects whether the present copying processing is a processing performed in the tab sheet inserting position.

The counter 102 counts the number of copy sheets fed during the image forming operation. The counter 102 also includes a plurality of count portions for counting the number of documents I to be fed, the number of fed sheets, etc.

The position detector 101 detects whether the present copying processing is a processing performed in the tab sheet inserting position in accordance with a tab sheet inserting position data TAB (K) (K=1, 2, . . ., n:n is a page number where the tab sheet is to be inserted) read from the CPU 200 and the number of documents I to be fed. The CPU 100 controls the transport path switching assembly 49 and drives the transport rollers 497 in accordance with the detection result of the position detector 101 to reverse the transport direction of the sheet.

Figure 4:
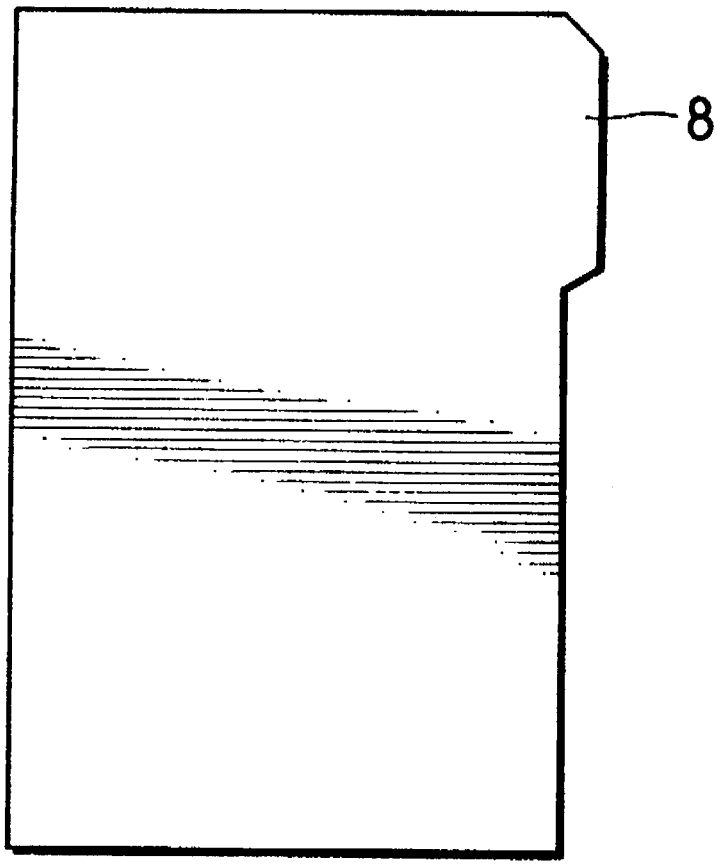
FIG. 4 is a diagram showing the shape of an exemplary tab sheet.

Subsequently, the copying operation in the tab sheet insertion mode is described. This operation is described with respect to the case of simplex copying for the sake of convenience. As shown in FIG. 4, the tab sheet has a tab 8 projecting from an upper part of a right longer side. The front surface of the tab sheet is such that the tab 8 projects from the upper part of the right longer side. An upper side of the tab sheet is where the tab 8 is formed.

As described above, in the copier according to this embodiment, a normal copying mode in which no image is copied on the tab sheets and a tab sheet copying mode in which an image is also copied on the tab sheets are selectively settable when the tab sheet insertion mode is set.

Figure 5:
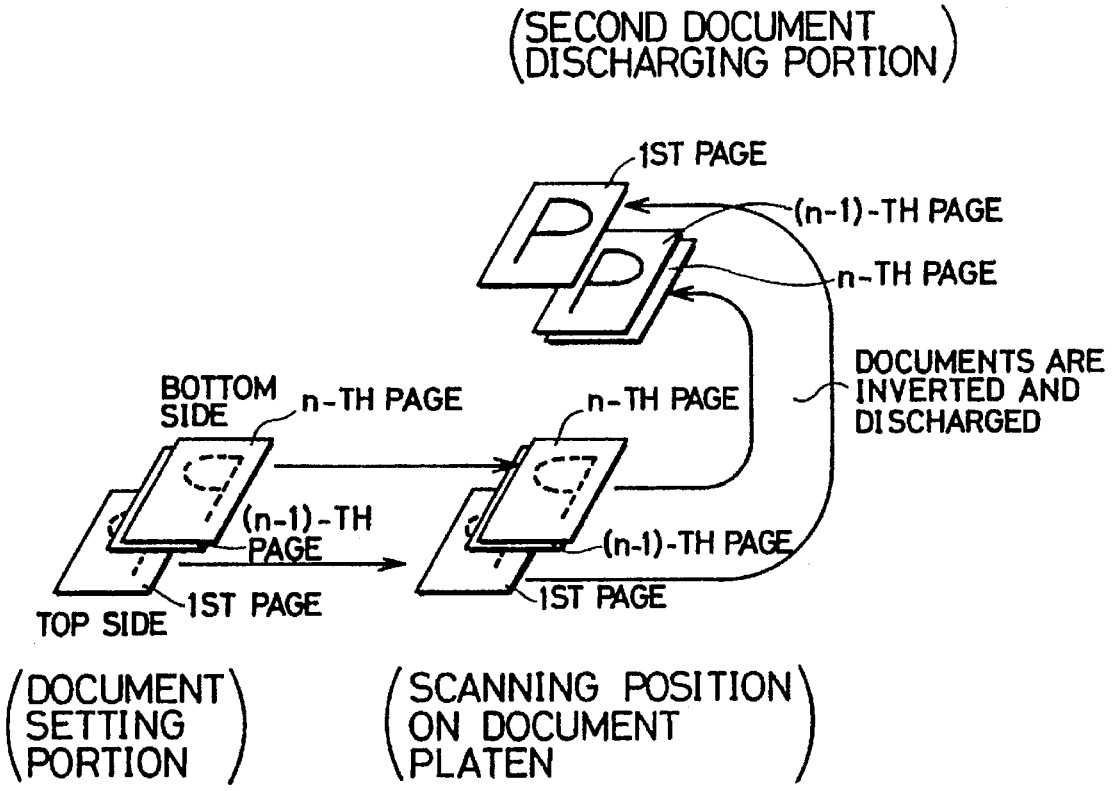
FIG. 5 is a diagram showing a transport of documents in a normal copying mode in which no image is copied on the tab sheet.
Figure 6:
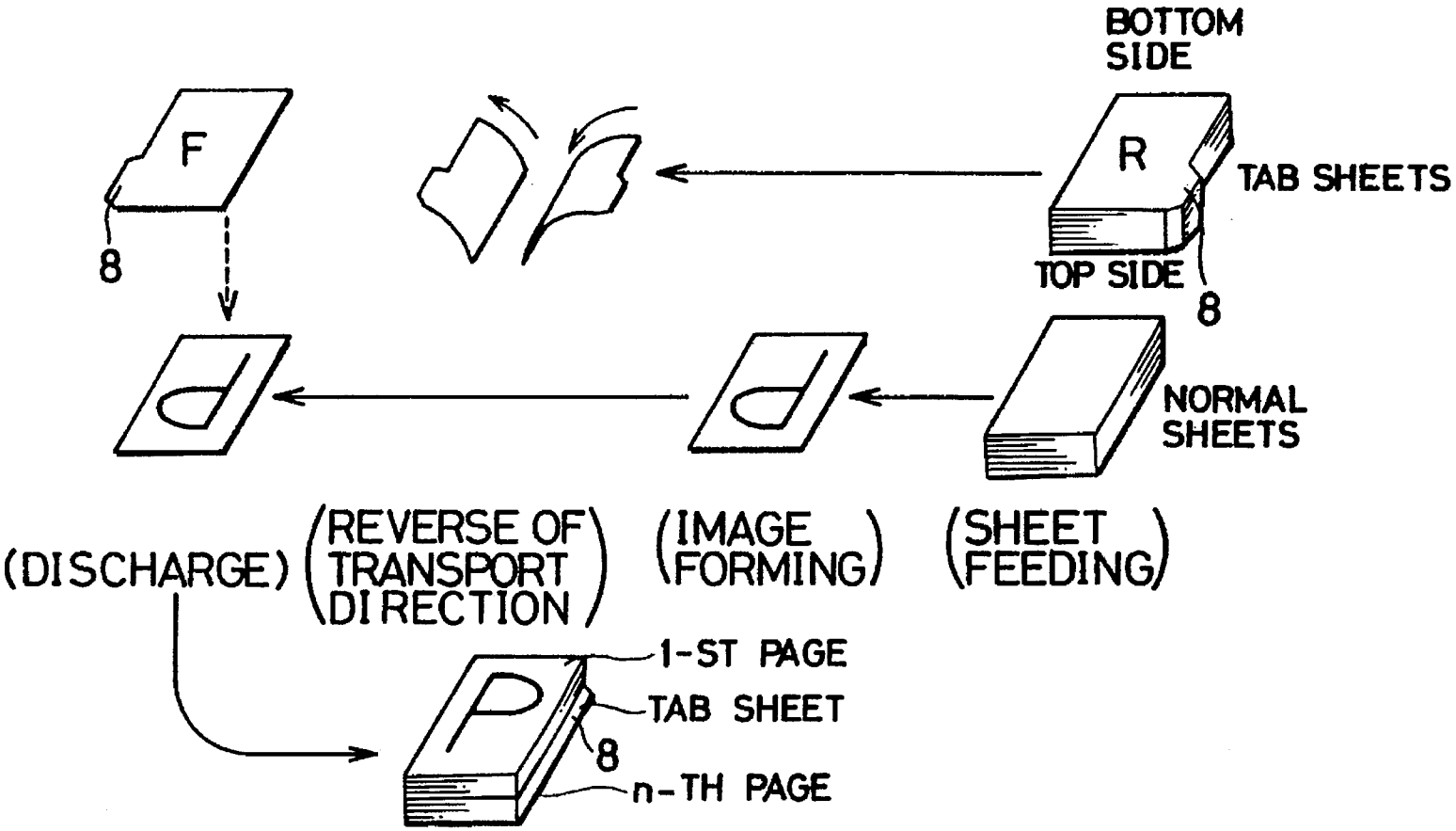
FIG. 6 is a diagram showing a transport of tab sheets and normal sheets in the normal copying mode.

FIG. 5 is a diagram showing a transport of documents in the normal copying mode, and FIG. 6 is a diagram showing a transport of tab sheets and normal sheets in the normal copying mode.

In the normal copying mode, the documents are faced downward (surface on which an image is to be copied is directed downward) and are set in the document setting portion 21 so that the top and bottom sides thereof are opposite from those of the tab sheets contained in the cassette before the copying operation is performed.

For example, if the tab sheets are contained in the cassette such that they are faced downward and their top sides are located at the bottom as shown in FIG. 6, the documents are set in the document setting portion 21 such that their top sides are located at the top as shown in FIG. 5 before the copying operation is performed.

During the copying operation, the respective documents are transported one by one from the uppermost one straight to the scanning position on the document platen 11 as shown in FIG. 5. Upon completion of the copying operation, the documents are discharged onto the second document discharging portion 234 after being inverted by the document inverting assembly 24. The documents are copied from the last page to the first page (in an increasing order) and are, therefore, discharged after being inverted so that the documents are stacked from the first page to the last page (in a decreasing order).

On the other hand, during the copying operation, the tab sheet is transported to the transport path switching assembly 49 without forming an image thereon and is discharged to the sheet processor 7 after having its transport direction reversed in the transport path switching assembly 49. The normal sheet is transported to the transport path switching assembly 49 after an image is formed thereon and is discharged to the sheet processor 7 without having its transport direction reversed in the transport path switching assembly 49 (see FIG. 6). In other words, the discharged normal sheets bearing copied images are stacked in the increasing order while the tab sheets inverted so as to be faced upward are inserted into the specified tab sheet inserting positions.

The tab sheets are discharge after .having their transport direction reversed so that both normal sheets and tab sheets are faced upward in the obtained copied material and the tabs 8 are located forward with respect to the discharge direction of the copied material. Accordingly, in the sheet processor 7, the copied material can be smoothly aligned (sides of the respective sheets are aligned) and processed (punching and/or stapling are applied to the other longer sides of the sheets having no tabs).

Figure 7:
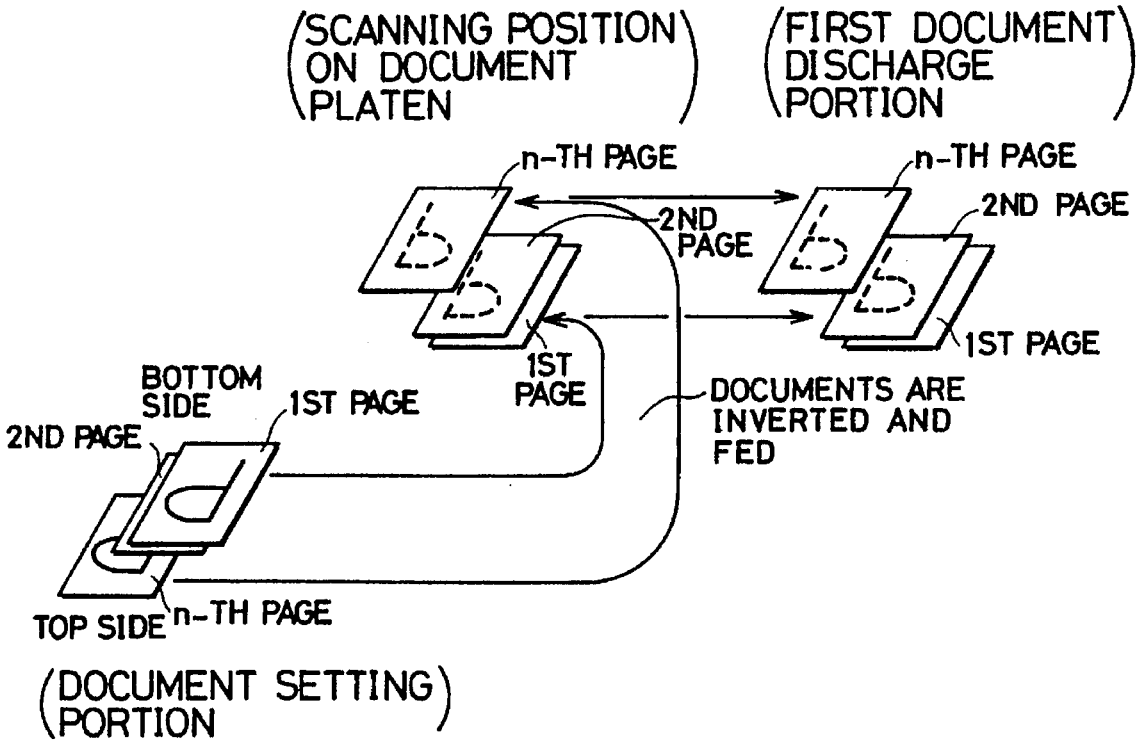
FIG. 7 is a diagram showing a transport of documents in a tab sheet copying mode in which an image is copied on the tab sheet.
Figure 8:
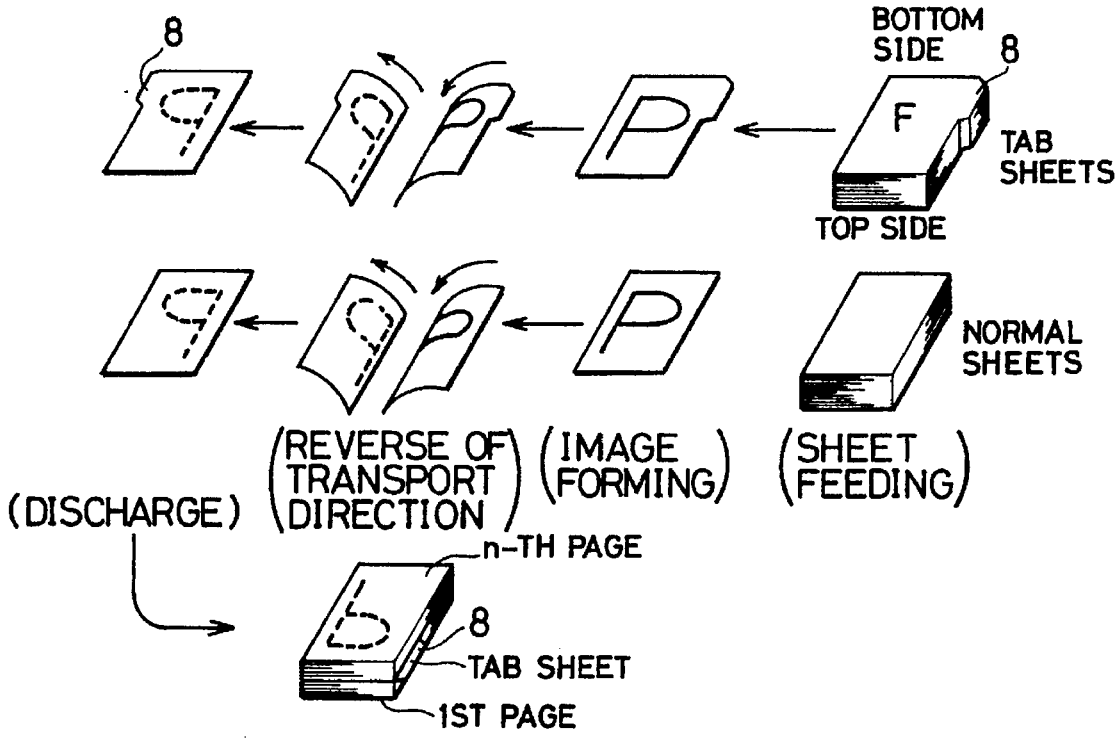
FIG. 8 is a diagram showing a transport of tab sheets and normal sheets in the tab sheet copying mode.

FIG. 7 is a diagram showing a transport of documents in the tab sheet copying mode, and FIG. 8 is a diagram showing a transport of tab sheets and normal sheets in the tab sheet copying mode.

In the tab sheet copying mode, before the copying operation is started, the documents are in the document setting portion 21 such that they are faced upward and their top sides are directed opposite from those of the tab sheets contained in the cassette.

For example, if the tab sheets are contained in the cassette such that they are faced upward and their top sides are located at the top as shown in FIG. 8, the copying operation is performed by setting the documents in the document setting portion 21 such that their top sides are located at the bottom as shown in FIG. 7.

During the copying operation, the respective documents are transported one by one from the uppermost one straight to the document inverting assembly 24, and then to the scanning position on the document platen 11 as shown in FIG. 7. Upon completion of the copying operation, the documents are discharged straight onto the first document discharging portion 25. The documents are transported to the scanning position after being inverted in order to set the documents in the scanning position, faced downward. The documents are discharged straight after the copying operation because the documents are copied in the decreasing order and it is not, therefore, necessary to discharge them after having their sides inverted.

On the other hand, during the copying operation, the tab sheets and the normal sheets are transported to the transport path switching assembly 49 after the images are formed thereon, and are discharged to the sheet processor 7 after having their transport direction reversed in the transport path switching assembly 49 (see FIG. 8). In other words, the tab sheets and normal sheets bearing copied images are discharged to the sheet processor 7 in the decreasing order while the tab sheets inverted so as to be faced upward are inserted into the specified tab sheet inserting positions. The tab sheets and the normal sheets are discharged after having their transport direction reversed for the same reason as in the case where no images are copied on the tab sheets.

Next, a control executed for the copying operation in the tab sheet insertion mode is described.

Figure 9:
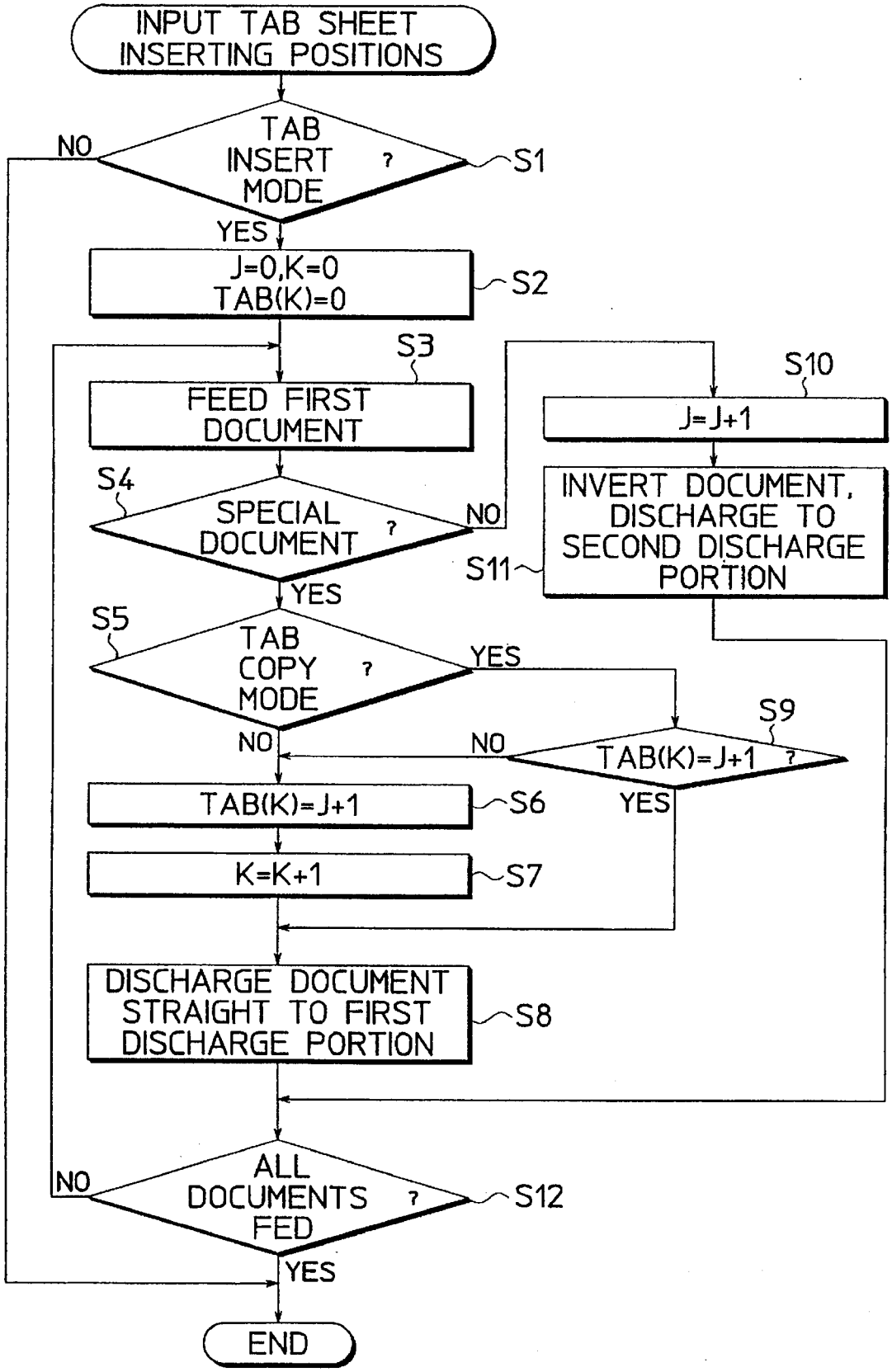
FIG. 9 is a flowchart showing a control for detecting an inserting position of a tab sheet in an automatic document feeder.

FIG. 9 is a flowchart showing a control executed to input the tab sheet inserting positions by means of the automatic document feeder 2.

When the tab sheet insertion mode is set, the control of FIG. 9 is executed to input the tab sheet inserting positions by means of the automatic document feeder 2.

Figure 10:
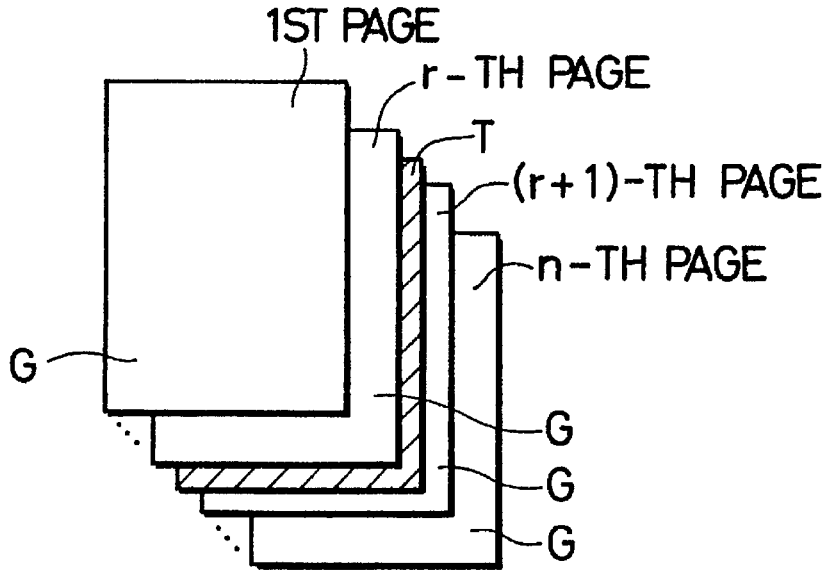
FIG. 10 is a diagram showing a set of documents including the tab sheets to be fed in the normal copying mode.

A document set used to input the tab sheet inserting positions defers depending upon whether the tab sheet copying mode is set or not if the normal copying mode is set, there is used a document set in which a special document T is inserted in the tab sheet inserting position (between r and (r+1) pages of the set of documents G as shown in FIG. 10. If the tab sheet copying mode is set, there is used a document set in which a special document T and a document Gt bearing an image to be copied on the tab sheet (hereinafter, "tab sheet document") are inserted in the tab sheet inserting position. At this time, the special document T is inserted before the tab sheet document Gt.

Figure 11:
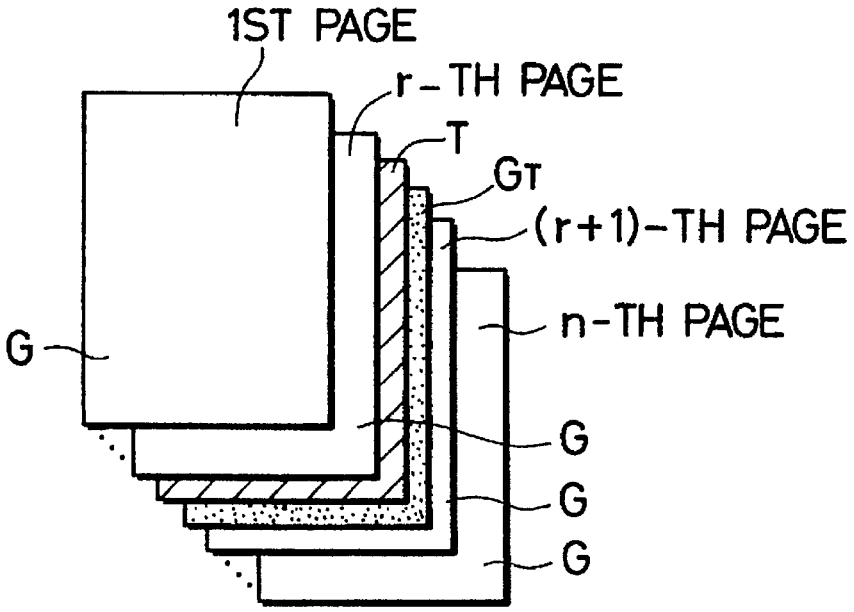
FIG. 11 is a diagram showing a set of documents including the tab sheets to be fed in the tab sheet copying mode.

If n and k denote the number of the documents G and the number of the special documents T or tab sheet documents Gt, respectively, a total number N of the documents used to input the tab sheet inserting positions in the normal copying mode is (n+k) since only the special documents T are inserted in the tab sheet inserting positions of the original document set G (see FIG. 10). A total number N of the documents used to input the tab sheet inserting positions in the tab sheet copying mode is (n+2k) since both special documents T and tab sheet documents Gt are inserted in the tab sheet inserting positions of the original document set (see FIG. 11).

When an operator operates a copy key 16 after setting a document set used to input the specified tab sheet inserting positions in accordance with whether the tab sheet copying mode is set or not (whether the set copying mode is the tab sheet copying mode or normal copying mode), the control of FIG. 9 is implemented.

First, it is discriminated whether the tab sheet insertion mode is set (Step S1). The control routine immediately ends if this mode is not set (NO in Step S1), whereas the counters J, K and the memories TAB(K) built in the CPU 200 are initialized (Step S2) if this mode is set (YES in Step S1). The counter J counts the number of the document set; the counter K counts pointers used to store the tab sheet inserting positions; and each memory TAB(K) stores data concerning the K-th tab sheet inserting position (insertion page).

Subsequently, the first document is fed (Step S3), and it is discriminated whether the fed document is a special document T in accordance with a detection signal of the special document detection switch 226 (Step S4).

If the fed document is a special document T (YES in Step S4), it is discriminated whether the tab sheet copying mode is set (Step S5). If this mode is not set (NO in Step S5), (J+1) is stored in the K-th (at first, K=0) memory TAB(K) (Step S6); a count value of the counter K is incremented by one (Step S7); and the fed document is discharged straight to the first document discharging portion 25 (Step S8).

On the other hand, if the tab sheet copying mode is set (YES in Step S5), it is discriminated whether the content of the K-th memory TAB(K) is (J+1) (Step S9). If TAB(K)=J+1 (YES in Step S9), Step S8 follows in which the fed document is discharged straight to the first document discharging portion 25. If TAB(K)≠J+1 (NO in Step S9), Step S6 follows in which (J+1) is stored in the K-th (at first, K=0) memory TAB(K). Subsequently, the count value of the counter K is incremented by one (Step S7), and the fed document is discharged straight to the first document discharging portion 25 (Step S8).

If the fed document is not a special document T, i.e. a normal document G (NO in Step S4), the count value of the counter J is incremented by one (Step S10), and the normal document G is discharged to the second document discharging portion 234 after being inverted in the document inverting assembly 24 (Step S11).

Subsequently, it is discriminated in accordance with the detection signal of the document sensor 224 whether all documents have been fed (Step S12). If there remain(s) other document(s) (NO in Step S12), Step S3 follows in which the second document is fed. Hereafter, the above operation is performed for all documents in the similar procedure. Upon completion of feed of all documents (YES in Step S12), the processing for inputting tab sheet inserting positions ends.

It should be appreciated that the special document T is discharged to the first document discharging portion 25 in Step S8 and the normal document is discharged to the second document discharging portion 234 in Step S11 in order to save the operator's labor by automatically separating the special documents T and the normal documents G after the tab sheet inserting position input processing.

Figure 12:
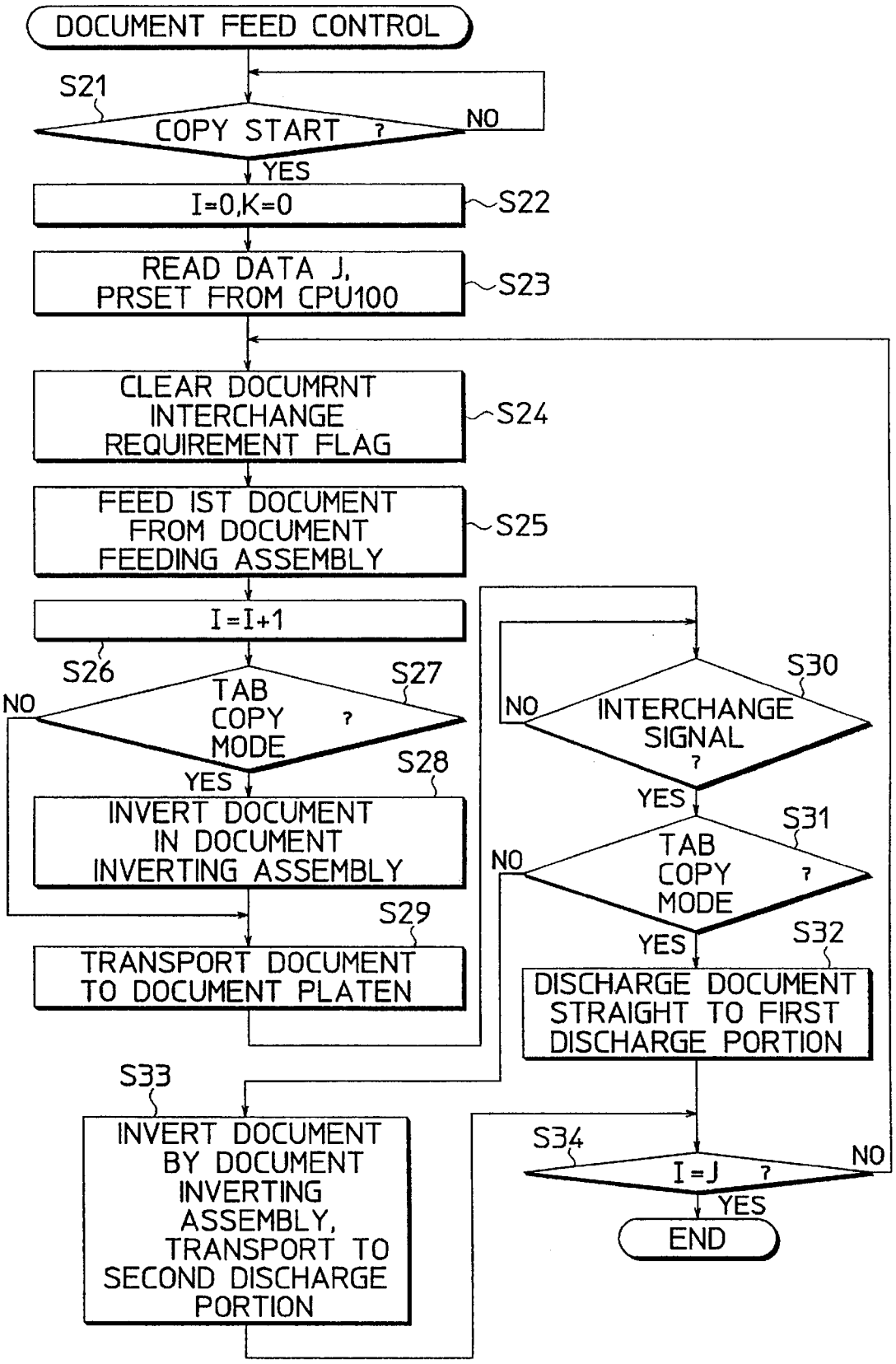
FIG. 12 is a flowchart showing a document feed control executed during a copying operation in a tab sheet insertion mode.
Figure 13:
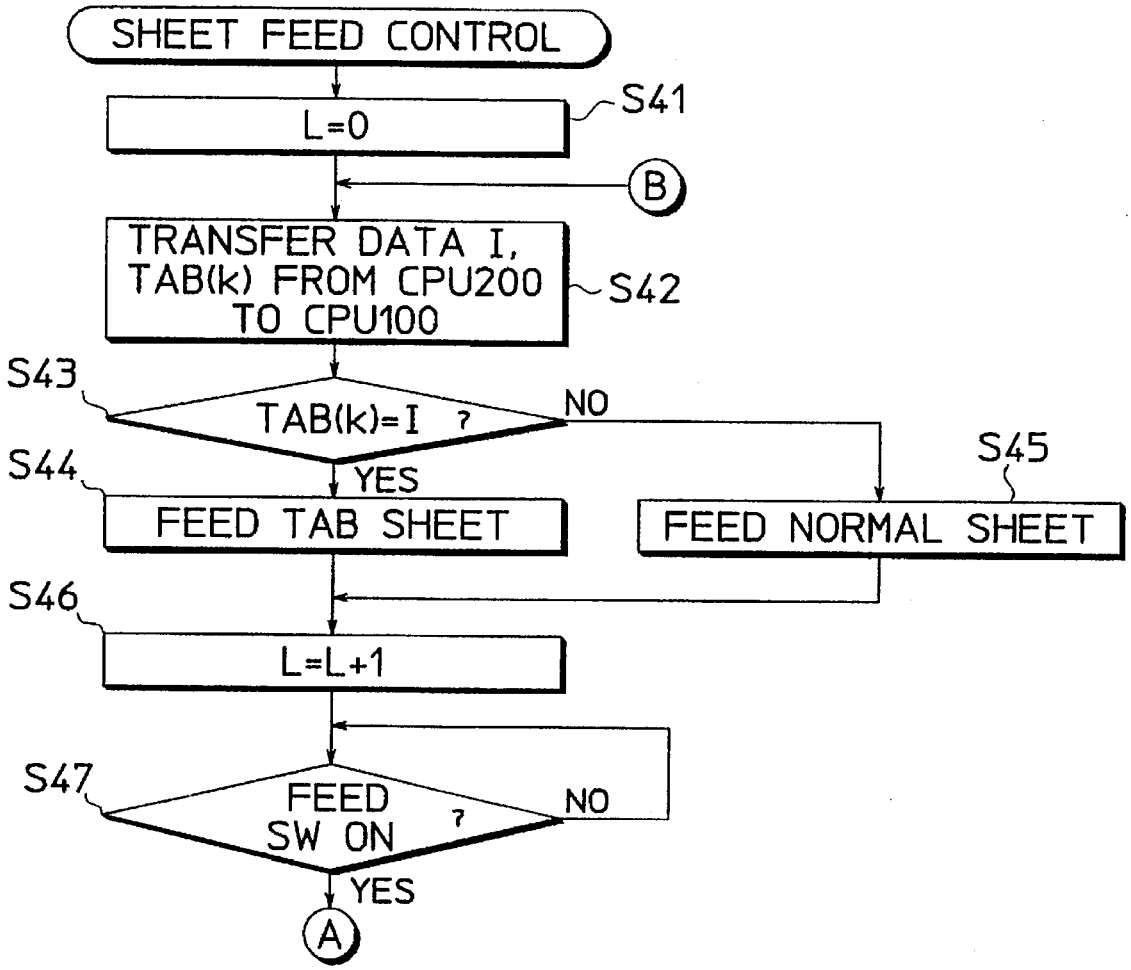
FIGS. 13 and 14 are flowcharts showing a sheet feed control executed during the copying operation in the tab sheet insertion mode.
Figure 14:
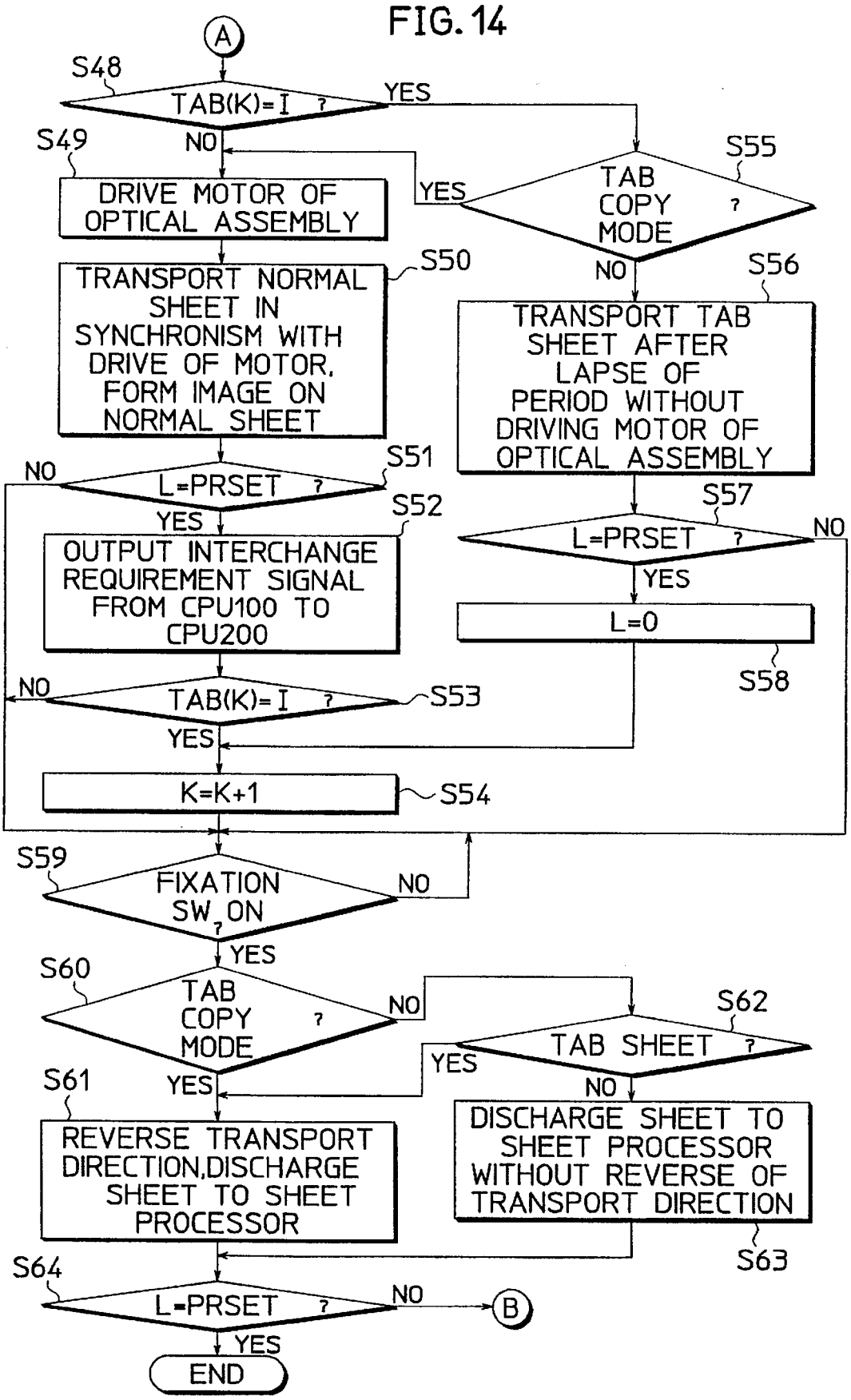

FIG. 12 is a flowchart showing a document feed control executed during the copying operation in the tab sheet insertion mode, and FIGS. 13 and 14 are flowcharts showing a sheet feed control executed during the copying operation in the tab sheet insertion mode. FIG. 12 is a flowchart of a control implemented by the CPU 200, and FIGS. 13 and 14 are flowcharts of a control implemented by the CPU 100.

After detecting the tab sheet inserting positions by means of the automatic document feeder 2, a specified document set is set in the document setting portion 21 according to the set copying mode, and the copy key 16 is operated, thereby starting a copying operation. The documents are fed in accordance with the control of FIG. 12, while the sheets (normal sheets and tab sheets) are fed in accordance with the control of FIGS. 13 and 14.

It is assumed that, during the actual copying operation in the tab sheet insertion mode, the set of documents G including no special documents T is set in the document setting portion 21. Specifically, in the normal copying mode, the document set consisting of documents G (e.g. the document set shown in FIG. 10 minus the special document T) is set in the document setting portion 21 such that they are faced downward and their sides are set as specified. In the tab sheet copying mode, a document set including the documents G and the tab sheet documents Gt (e.g. the document set shown in FIG. 11 minus the special document T) is set in the document setting portion 21 such that they are faced upward and their top sides are set as specified.

First, the document feed control is described.

When a start of the copying operation is instructed by means of the copy key 16 (YES in Step S21), the counters I, K are initialized (Step S22); a data J concerning the number of documents G and a data PRSET concerning the number of copies to be made are read from the CPU 100 (Step S23); and a document interchange requirement flag is cleared (Step S24). The counter I counts the number of fed documents, and the counter K counts pointers used to read the K-th tab sheet inserting position of the data TAB(K) read from the CPU 200.

Subsequently, the first document is fed from the document feeding assembly 22 (Step S25), and the count value of the counter I is incremented by one in accordance with a detection signal of the registration switch 225 (Step S26).

It is then discriminated whether the tab sheet copying mode is set (Step S27). The fed document is transported to the scanning position on the document platen 11 after being inverted in the document inverting assembly 24 (Steps S28, S29) if this mode is set (YES in Step S27), while being transported straight to the scanning position without being inverted if this mode is not set (NO in Step S27). The document is kept set in the scanning position until a document interchange requirement signal is input from the CPU 100 (a loop of Step S30).

The document interchange requirement signal is output from the CPU 100 to the CPU 200 when the copying operation is performed for the next document upon completion of the image forming operation for the former document. In the case that a plurality of copies are to be made for the same document, the document interchange requirement signal is output upon completion of the corresponding number of copying operations.

Since the copying operation is performed for each of the fed document G and tab sheet document Gt in the tab sheet copying mode, the document interchange requirement signal is output to the CPU 200 each time a specified image forming operation for the normal sheet or tab sheet is completed.

In the case that a tab sheet is inserted between the two consecutive documents in the normal copying mode, after the tab sheet is inserted while the following document is set in the scanning position, the image of the following document is copied on the normal sheet. Accordingly, for the document in the tab sheet inserting position (i.e. the document before which the tab sheet is inserted), the document interchange requirement signal is output to the CPU 200 after the tab sheet insertion and the image formation on the normal sheet. For the other documents (i.e. the documents before which the tab sheet is not inserted), the document interchange requirement signal is output to the CPU 200 after the image formation on the normal sheet.

Upon input of the document interchange requirement signal from the CPU 100 (YES in Step S30), it is discriminated whether the tab sheet copying mode is set (Step S31). The document in the scanning position is discharged straight to the first document discharging portion 25 (Step S32) if this mode is set (YES in Step S31), while being transported to the second document discharging portion 234 after being inverted by the document inverting assembly 24 (Step S33) if this mode is not set (NO in Step S31).

The reason why the feed and discharge of the document are changed depending upon whether or not the tab sheet copying mode is set lies in the fact that the documents are differently set (in which direction the documents are faced and the top sides thereof are directed) depending upon whether or not the tab sheet copying mode is set as described with reference to FIGS. 5 and 7.

Subsequently, it is discriminated whether the count value of the counter I is equal to the number J of documents G, thereby discriminating whether all documents have been fed (Step S34). If I≠J (NO in Step S34), Step S24 follows since there still remain the documents to be fed, and the above operation is performed for the next document. If I=J (YES in Step S34), the feed of the documents is completed since all documents have been fed.

Next, the sheet feed control is described.

Here, for the sake of convenience, a case where the tab sheets and the normal sheets are contained in the cassettes 61 and 62, respectively is described.

First, the counter L is initialized to 0 (Step S41), the data I representing the number of the fed documents and the tab sheet inserting position data TAB(K) are transferred from the CPU 200 to the CPU 100 (Step S42). The counter L counts the number of sheets to be fed from the feeder unit 6.

Subsequently, it is discriminated whether the number I of the fed documents agrees with the K-th tab sheet inserting position data TAB(K) (Step S43). If TAB(K)=I (YES in Step S43), it is a tab sheet inserting position and accordingly a tab sheet is fed from the cassette 61 (Step S44). If TAB(K)≠I (NO in Step S43), it is not a tab sheet inserting position and accordingly a normal sheet is fed from the cassette 62 (Step S45) and the count value of the counter L is incremented by one (Step S46).

It is waited until an unillustrated feed switch for detecting an arrival of the leading end of the fed document to a specified position is turned on. When the feed switch is turned on (YES in Step S47), it is discriminated whether a current copying operation is a processing in the tab sheet inserting position (i.e. the number I of the fed documents agrees with the K-th tab sheet inserting position data TAB (K)) (Step S48). If the discrimination result is in the negative (TAB(K)≠I, NO in Step S48), a motor of the optical assembly 3 is driven (Step S49) and the fed normal sheet is further transported to the registration rollers 501 in synchronism with the driving of the motor so that an image is formed on this normal sheet (Step S50).

Subsequently, it is discriminated whether the data L representing the number of the fed sheets agrees with the data PRSET representing the number of copies to be made from the same document (Step S51). If the discrimination result is in the negative (L≠PRSET, NO in Step S51), Step S59 follows. If the discrimination result is in the affirmative (L=PRSET, YES in Step S51), the document interchange requirement signal is output from the CPU 100 to the CPU 200 (Step S52) and it is discriminated whether a current copying operation is a processing in the tab sheet inserting position (i.e. the data I agrees with the data TAB(K)) (Step S53). Step S59 follows if the discrimination result is in the negative (TAB(K)≠I, NO in Step S53).

If the current copying operation is a processing in the tab sheet inserting position (TAB(K)=I, YES in Step S53), Step S59 follows after the count value of the counter K is incremented by one (Step S54). In Step S59, it is waited until a fixation switch for detecting an arrival of the sheet being transported to the fixing device 48 is turned on. In other words, it is waited until the sheet is transported to the fixing device 48.

On the other hand, if the discrimination result in Step S48 is in the affirmative (TAB(K)=I), it is discriminated whether the tab sheet copying mode is set (Step S55). If the tab sheet copying mode is set (YES in Step S55), there follows Step S49 in which the motor of the optical assembly 3 is driven similarly to the case where the normal sheet is fed; the tab sheet is further transported by the registration rollers 501 in synchronism with the driving of the motor so that an image is formed on this tab sheet (Steps S49 to S54).

If the tab sheet copying mode is not set (NO in Step S55), the tab sheet is further transported by the registration rollers 501 after lapse of a specified period without driving the motor of the optical assembly 3 (Step S56). Subsequently, it is discriminated whether the data L agrees with the data PRSET (Step S57). If L≠PKSET (NO in Step S57), there follows Step S59 in which the fixation switch is turned on. If L=PRSET (YES in Step S57), Step S59 follows after the counter L is reset to "0" (Step S58). In Step S59, it is waited until the fixation switch is turned on.

As described above, since no image is formed on the tab sheet in the normal copying mode, the optical assembly 3 is not driven. Further, in the tab sheet copying mode, since a tab sheet is inserted between the sheet corresponding to the document set in the scanning position and the sheet corresponding to the foregoing document, no document interchange requirement signal is output during the feed of the tab sheet.

When the fixation switch is turned on (YES in Step S59), it is discriminated whether the tab sheet copying mode is set (Step S60). If the tab sheet copying mode is set (YES in Step S60), the sheet having passed the fixing device 48 is discharged to the sheet processor 7 after having its transport direction reversed in the transport path switching assembly 49 (Step S61). If the tab sheet copying mode is not set (NO in Step S60), it is discriminated whether the fed sheet is a tab sheet (Step S62). If the sheet being transported is a tab sheet (YES in Step S62), it is discharged to the sheet processor 7 after having its transport direction reversed in the transport path switching assembly 49 (Step S61). If the sheet being transported is a normal sheet (NO in Step S62), it is discharged to the sheet processor 7 without having its transport direction reversed in the transport path switching assembly 49 (Step S63).

The sheet discharge in Steps S60 to S63 is performed as described with reference to FIGS. 6 and 8.

Subsequently, it is discriminated whether the data L agrees with the data PRSET (Step S64). If L≠PRSET (NO in Step S64), Step S42 follows and the above operation is performed for the next sheet. If L=PRSET (YES in Step S64), the sheet feed control ends since the copying operation has been completed.

Although the tab sheet inserting positions are detected by means of the automatic document feeder 2 in the foregoing embodiment, the tab sheet inserting position data may be input by means of the setting key 17 provided in the operation panel. In this case, if the input data is stored in the memories TAB(K), the feed control for the documents and the sheets can be executed in the same manner as described above.

In the foregoing embodiment, the tab sheet inserting positions are input by means of the automatic document 2 before the copying operation. However, the tab sheet inserting positions may be detected during the copying operation. The sheet to be fed may be switched in accordance with the kind of the fed document (normal document or special document) so that the copying operation in the tab sheet insertion mode can be immediately started. This arrangement improves the efficiency of the copying operation since the operation for inputting the tab sheet inserting positions can be omitted.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus in which a plurality of documents are fed one by one to a scanning position and toner images of the respective documents are formed in an imaging assembly in accordance with the images scanned in the scanning position while copy sheets are fed to the imaging assembly in synchronism with feed of the respective documents, and the toner images are transferred to the copy sheets which are then stackingly discharged in a discharging portion, the image forming apparatus comprising:

a tab sheet feeding device which contains tab sheets in such a state that tabs of the tab sheets project backward with respect to a feed direction;

a sheet inverting device which is provided downstream from the imaging assembly to discharge the sheet to the discharging portion after reversing its transport direction;

an inserting position setting device which sets an inserting position of the tab sheet in a plurality of copy sheets to be stackingly discharged;

a feed controller which feeds a tab sheet from the tab sheet feeding device during a processing in the inserting position;

an image formation prohibiting device which prohibits an image formation during the processing in the inserting position; and a transport controller which transports, when the fed sheet is a tab sheet, the tab sheet to the sheet inverting device.

2. An image forming apparatus according to claim 1, further comprising:

a refeeding device which feeds the copy sheet having an image copied on the front side thereof again to the imaging assembly so as to form an image on the rear side of the copy sheet; and a transport path switching device which switches a transport path of the sheet being transported to the refeeding device and to the discharging portion.

3. An image forming apparatus according to claim 2, wherein the sheet inverting device includes:

a switching member having a triangular cross section which is movable between a discharge position where it guides the sheet to the discharging portion and a circulation position where it guides the sheet to the refeeding device;

three guide plates disposed in parallel to the respective planes of the switching portions so as to define, together with the switching portion, a first discharge path for guiding the sheet transported from the imaging assembly to the discharging portion, a circulation path for guiding the sheet to the refeeding device, and a second discharge path for guiding the sheet having its transport direction reversed to the discharging portion;

a driving device which is provided in a specified position along a transport path extending from the circulation path to the refeeding device and transport the sheet to have its transport direction reversed back to the second discharge path;

a switch controller which moves, when the sheet being transported is a tab sheet, the switching member to the circulation position; and a drive controller which drives, when the sheet being transported is a tab sheet, the driving device at a specified timing after the tab sheet passes the circulation path.

4. An image forming apparatus according to claim 1, wherein the inserting position setting device is realized by an automatic document feeder which feeds a plurality of documents one by one to the scanning position, the documents including a special document inserted in a specified page position to indicate a tab sheet inserting position, and includes:

a distinguishing device which distinguishes the special document from other normal documents;

a counting device which counts the number of the normal documents; and a position determining device which determines the inserting position of the tab sheet in a plurality of stackingly discharged copied sheets in accordance with the number of the normal documents.

5. An image forming apparatus according to claim 1, wherein the inserting position setting device includes:

a page information inputting device which inputs information concerning the latter one of the pages between which the tab is inserted; and a position determining device which determines the inserting position of the tab sheet in a plurality of stackingly discharged copied sheets in accordance with the information input by the page information inputting device.

6. An image forming apparatus according to claim 1, further comprising:

a mode setting device which sets a tab sheet copying mode; and a prohibition removing device which removes, when the tab sheet copying mode is set, a prohibition on the image formation during the processing in the inserting position so as to form an image on the tab sheet fed from the tab sheet feeding device.

* * * * *